US008215989B2

(12) United States Patent
Tamm et al.

(10) Patent No.: US 8,215,989 B2
(45) Date of Patent: Jul. 10, 2012

(54) AUDIO JACK WITH EMI SHIELDING

(75) Inventors: Carsten Tamm, Bochum (DE); Wolfgang Edeler, Bochum (DE)

(73) Assignee: Research In Motion Limited, Waterloo (CA)

( * ) Notice: Subject to any disclaimer, the term of this patent is extended or adjusted under 35 U.S.C. 154(b) by 305 days.

(21) Appl. No.: 12/573,668

(22) Filed: Oct. 5, 2009

(65) Prior Publication Data

US 2011/0081022 A1 Apr. 7, 2011

(51) Int. Cl.
*H01R 13/648* (2006.01)

(52) U.S. Cl. ..... 439/607.01; 439/607.36; 439/668; 381/1; 381/74; 381/77

(58) Field of Classification Search ..... 439/101, 439/188, 541.5, 607.01, 607.03, 607.23, 439/607.36, 668, 669; 381/1, 74, 394, 77, 381/124

See application file for complete search history.

(56) References Cited

U.S. PATENT DOCUMENTS 5,017,158 A 5/1991 Liu
5,312,273 A 5/1994 Andre et al.
5,338,215 A * 8/1994 Lee et al. ..... 439/188
6,050,854 A 4/2000 Fang et al.
6,109,966 A 8/2000 Chiou
6,213,812 B1 4/2001 Kan
6,290,535 B1 9/2001 Lin et al.
6,346,013 B1 2/2002 Zhang
6,407,932 B1 6/2002 Gaio et al.
6,482,044 B1 11/2002 Ma et al.
6,676,423 B1 1/2004 Marowsky et al.
6,997,742 B1 2/2006 Tung
2008/0318457 A1 * 12/2008 Li et al. ..... 439/188

OTHER PUBLICATIONS

Examination Report; European Patent App. No. 09172260.3; dated Jan. 9, 2010.
EESR; EP Patent App. No. 09172260.3; mailed Mar. 25, 2010.

* cited by examiner

*Primary Examiner* — Vivian Chin
*Assistant Examiner* — Friedrich W Fahnert
(74) *Attorney, Agent, or Firm* — Novak Druce + Quigg LLP

(57) ABSTRACT

An audio jack for an audio plug for use in an electrical device, comprising a non-conductive enclosure having a front side and defining a cavity having an aperture within the front side for receiving the audio plug, the aperture having a first diameter, the cavity extending along a longitudinal axis; a conductive shielding formed from sheet metal folded over at least five sides of the enclosure including the front side, the shielding defining a shielding aperture centered on the enclosure aperture and having a second diameter larger than the first diameter; and a ground contact connected to the conductive shielding.

8 Claims, 5 Drawing Sheets

AUDIO JACK WITH EMI SHIELDING

TECHNICAL FIELD

The present application relates to electromagnetic shielding for electronic devices. More specifically, the application discloses an apparatus for shielding an audio jack to prevent electromagnetic interference and electrostatic discharging.

BACKGROUND

Electronic devices often have electrical inputs and outputs carried over cables connectable to the device by connectors. The electrical signals flowing through these connectors are prone to mutual electromagnetic interference (EMI) and electrostatic discharge with the other operations of the device or from outside the device. EMI effects from electrical cables and connectors connected to integrated circuits can be significant, and can interfere with radio communication and audio equipment. Accordingly, manufacturers of integrated circuit devices with connectable electrical cables have a need to reduce the EMI effects of electrical connectors in electronic devices containing integrated circuits.

DETAILED DESCRIPTION OF EXEMPLARY EMBODIMENTS

Figure 1:
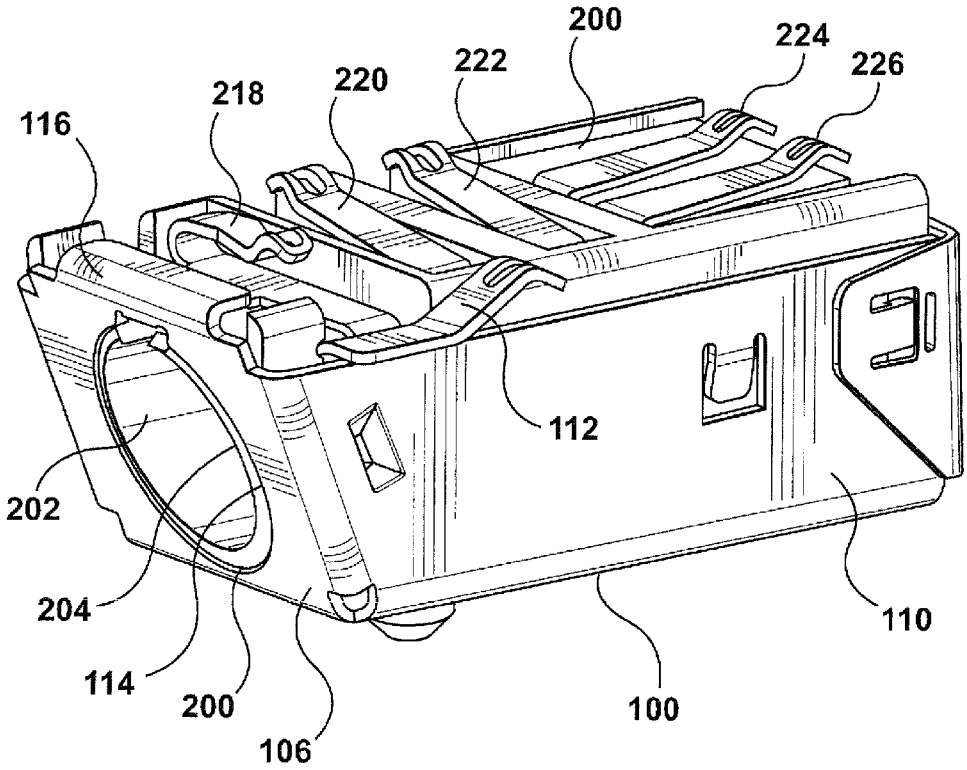
FIG. 1 is a perspective view of an exemplary embodiment of an audio jack with EMI shielding.

The present application describes an audio jack with shielding against electromagnetic interference (EMI).

In a first aspect, the application is directed to an audio jack for an audio plug for use in an electrical device, comprising a non-conductive enclosure having a front side and defining a cavity having an aperture within the front side for receiving the audio plug, the aperture having a first diameter, the cavity extending along a longitudinal axis; a conductive shielding formed from sheet metal folded over at least five sides of the enclosure including the front side, the shielding defining a shielding aperture centered on the enclosure aperture and having a second diameter larger than the first diameter; and a ground contact connected to the conductive shielding.

In another aspect, the application is directed to a non-conductive stopping member extending from a surface of the enclosure, the non-conductive stopping member extending substantially perpendicular to the longitudinal axis of the cavity and adapted to abut a complementary surface, thereby transferring any forces upon the audio jack along the longitudinal axis to the complementary surface.

In a further aspect, the ground contact is connected to the conductive shielding proximal to the shielding aperture.

In a further aspect, the ground contact comprises a spring contact.

In a further aspect, the application is directed to one or more cavity contacts situated within the cavity to come into electrical communication with one or more conductive surfaces of an inserted audio plug.

In a further aspect, the application is directed to one or more PCB spring contacts adapted to connect to and electrically communicate with leads of a printed circuit board, each PCB contact being in electrical communication with one or more of the cavity contacts.

In a further aspect, the application is directed to an electronic device incorporating the audio jack, comprising a rigid, non-conductive case defining an aperture centered on the on the enclosure aperture and having a diameter smaller than the second diameter.

In a further aspect, the diameter of the case aperture is substantially the same as the first diameter.

In a further aspect, the application is directed to an electronic device incorporating the audio jack, comprising a rigid, non-conductive case defining an aperture centered on the on the enclosure aperture and having a diameter smaller than the second diameter; an audio subsystem having a left stereo speaker signal output, a right stereo speaker signal output, and a microphone signal input; and a printed circuit board having a left stereo speaker lead in communication with the left stereo speaker signal output of the audio subsystem, a right stereo speaker lead in communication with the right stereo speaker signal output of the audio subsystem, and a microphone lead in communication with the microphone signal input of the audio subsystem, the left stereo speaker lead, right stereo speaker lead, and microphone lead being positioned such that each comes into contact with one or more of the PCB contacts of the audio jack when the audio jack is mounted on the printed circuit board.

In a further aspect, the cavity contacts of the audio jack comprise a microphone cavity contact in communication with a PCB contact positioned to communicate with the microphone lead of the printed circuit board; a right speaker cavity contact in communication with a PCB contact positioned to communicate with the right speaker lead of the printed circuit board; and a left speaker cavity contact in communication with a PCB contact positioned to communicate with the right speaker lead of the printed circuit board.

In a further aspect, the application is directed to a system ground; the printed circuit board further comprises a system ground lead in communication with the system ground and positioned to come into communication with one or more of the PCB contacts of the audio jack; and the cavity contacts further comprise a system ground cavity contact in communication with a PCB contact positioned to communicate with the system ground lead of the printed circuit board.

In a further aspect, the microphone cavity contact, the system ground cavity contact, the right speaker cavity contact, and the left speaker cavity contact are arranged in sequence from the enclosure aperture to the distal end of the cavity.

In a further aspect, the application is directed to an electronic device incorporating the audio jack, comprising a rigid, non-conductive case defining an aperture centered on the on the enclosure aperture and having a diameter smaller than the second diameter; and a stopping surface placed so as to abut and complement the non-conductive member of the enclosure and absorb any force on the audio jack along the longitudinal axis.

Figure 2:
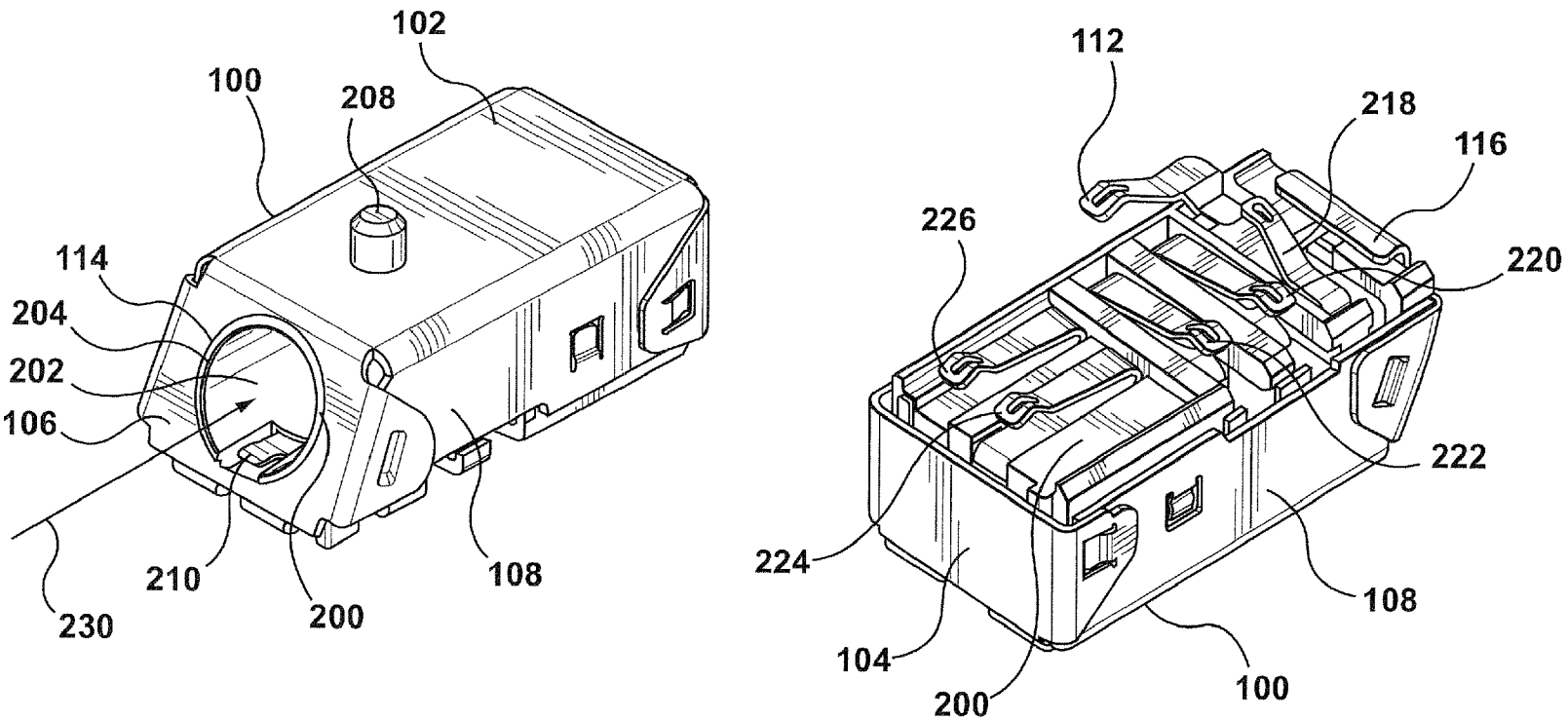
FIG. 2 shows two perspective views showing the exemplary embodiment from FIG. 1 in two different orientations.

FIG. 1 and FIG. 2 show an exemplary embodiment of an audio jack with EMI shielding. In this embodiment, the jack comprises two distinct pieces: a conductive shielding 100 substantially enclosing a non-conductive enclosure 200.

The enclosure 200 is formed from a non-conductive material such as a hard plastic. The enclosure 200 is formed in this embodiment from a single piece of plastic. It is substantially a rectangular prism with an angled front face. The enclosure 200 defines a hollow cavity 202 shaped to accommodate an electrical connector, namely an audio plug of the TRS ("tip-ring-sleeve") or TRRS ("tip-ring-ring-sleeve") variety. The shape of the cavity 202 is substantially complementary to the shape of the audio plug, and the front face of the enclosure 200 defines an aperture 204 through which a plug can be inserted into the cavity 202 along the longitudinal axis 230 of the cavity 202. The elliptical shape of this aperture 204 is such that, viewed along the longitudinal axis 230 of the cavity 202, it presents a circular profile corresponding fairly closely to the diameter of a corresponding audio plug.

Within the cavity 202 are one or more electrical contacts designed to communicate electrically with corresponding contacts on an inserted plug; the front-most of these contacts is shown in FIG. 2 as a first cavity contact 210. These cavity contacts extend into spring contacts adapted to connect to the surface of a printed circuit board (PCB) of a device in which the jack is mounted. In this embodiment, five such spring contacts are shown, comprising a first PCB spring contact 218, a second PCB spring contact 220, a third PCB spring contact 222, a fourth PCB spring contact 224, and a fifth PCB spring contact 226. Each of these spring contacts may be an extension of one or more of the cavity contacts, such as the first cavity contact 210, and a single cavity contact may extend into more than one spring contact. Alternatively, one or more of these spring contacts may be an extension of an electrical component within the enclosure 200 other than one of the cavity contacts.

The shielding 100 is formed from a conductive material, such as copper, gold, or another metal, that acts to block EMI. The shielding 100 has five faces that substantially enclose five sides of the enclosure 200. These faces are designated herein with reference to their general orientation in FIG. 1: a bottom face 102, a back face 104, a front face 106, a left face 108, and a right face 110. The top of the enclosure 200 (given the orientation of FIG. 1) is at least partially exposed, showing the non-conductive material from which the enclosure 200 is formed. The shielding 100 in this embodiment is formed from a single sheet of conductive material, which is stamped out in a specific shape, then folded and crimped to form the final shape. The front face 106 of the shielding 100 defines an elliptical aperture 114 larger than the diameter of a corresponding audio plug. This elliptical shape is slightly larger than that of the of the enclosure aperture 204, leaving a small gap between the inside circumference of the shielding aperture 114 and the circumference of the enclosure aperture 204, thereby preventing an inserted plug from coming into electrical contact with the shielding 100. It will be appreciated that although the cavity 202 is substantially cylindrical, the apertures 204 and 114 appear elliptical due to the angled front face 106.

The bottom face 102 of the shielding 100 defines an opening through which a mechanical stopping pin 208 of the enclosure 200 protrudes. The front face 106 of the shielding 100 is secured to the enclosure 200 in part through a clip 116 that extends around the corner between the front and top surfaces of the enclosure 200.

The shielding 100 additionally comprises a grounding spring contact 112 extending from the shielding 100 proximal to the front face 106 of the shielding 100 and to the shielding aperture 114. The grounding spring contact 112 is adapted to connect to the grounding plane of a PCB on which the jack is mounted and to thereby ground the shielding 100 to the resident device's system ground. The proximity of the grounding spring contact 112 to the front face 106 and shielding aperture 114 minimizes the interference effects created in the event of a spark discharge from an inserted plug due to electrostatic buildup on the plug: any plug which discharges an electrostatic charge into the shielding 100 by sparking over the gap between the shielding aperture 114 and the enclosure aperture 204 will have the charge grounded immediately to the system ground via the grounding spring contact 112 without creating a current through the length of the shielding 100 during the discharge. Furthermore, the use of a single grounding spring contact 112 instead of multiple such contacts reduces the risk of ground loops and other unwanted electrical artifacts within the shielding 100.

Figure 3:
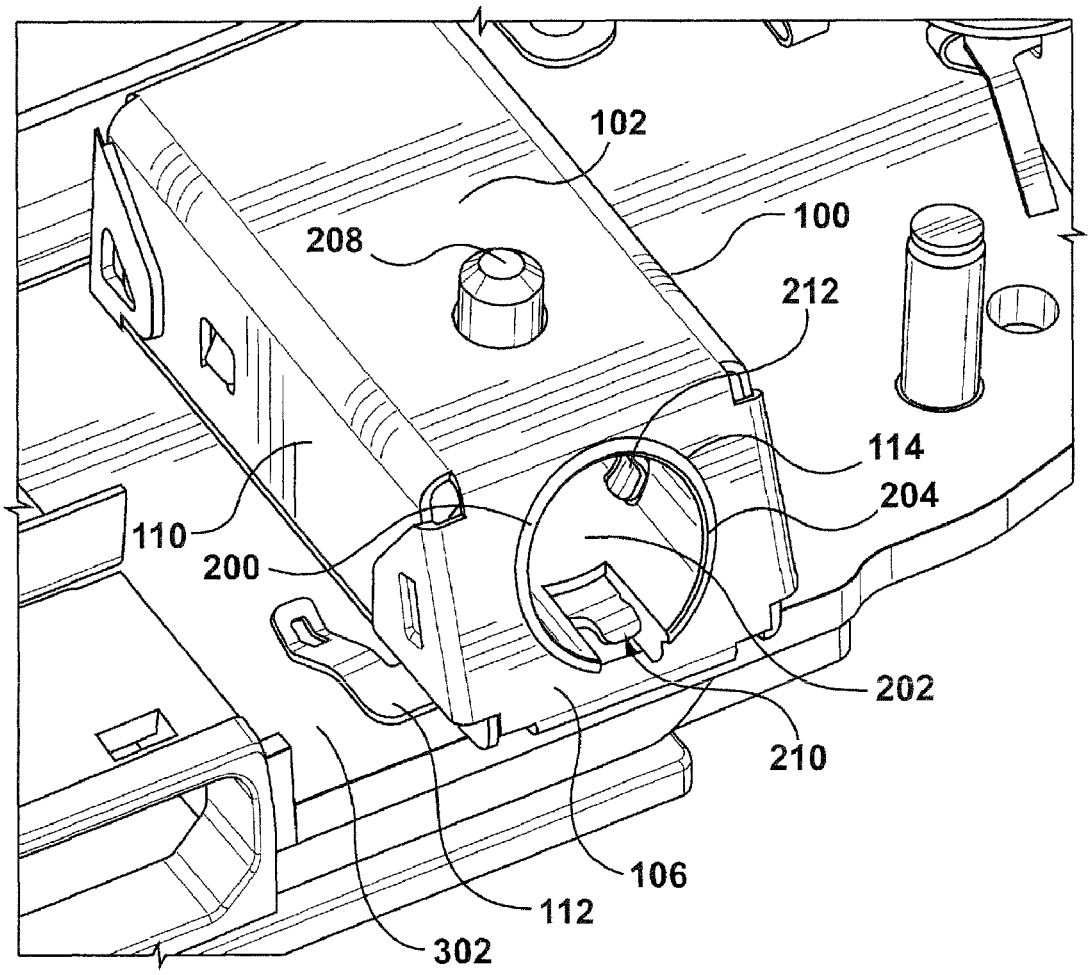
FIG. 3 is a perspective view of the exemplary embodiment of FIG. 1 mounted on a printed circuit board of an exemplary electronic device.

FIG. 3 shows the exemplary embodiment of the audio jack from FIGS. 1 and 2 mounted on the PCB 302 of an exemplary electronic device. The grounding spring contact 112 is shown in contact with the grounding plane of the PCB 302, while the various PCB spring contacts 218, 220, 222, 224 and 226 (not visible) are also in communication with various leads of the PCB 302. Here, the bottom face 102 of the shielding 100 is visible, with the mechanical stopping pin 208 of the enclosure 200 protruding upward. A second cavity contact 212 is here visible, deeper within the cavity than the first cavity contact 210.

Figure 4:
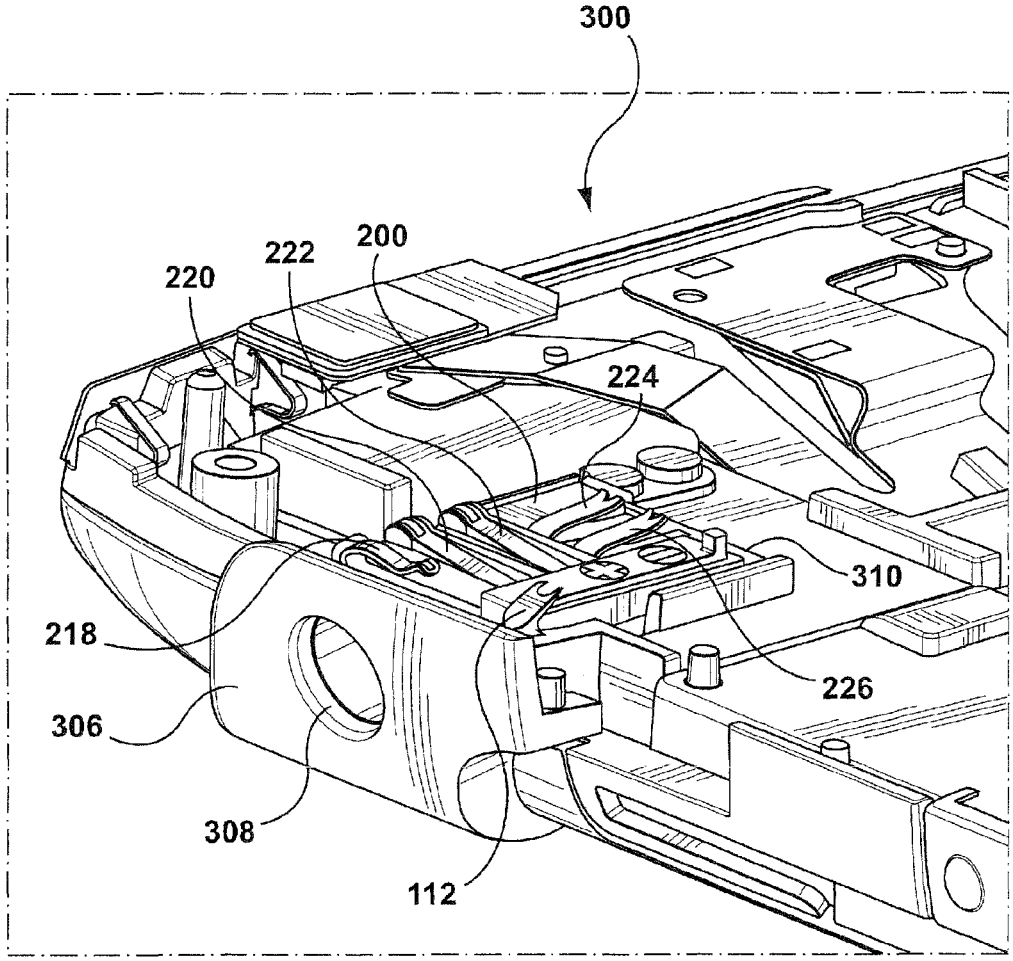
FIG. 4 is a partially cut-away perspective view of an exemplary electronic device with the exemplary embodiment of FIG. 1 mounted within.

FIG. 4 shows the exemplary audio jack of FIGS. 1 to 3 mounted within an exemplary electronic device 300, with more components of the device 300 in place than in FIG. 3. Here, a portion of the outer case 306 of the device is shown covering the front face 106 of the shielding 100 and defining a case aperture 308 with the same cross-sectional profile as the enclosure aperture 204 viewed along the longitudinal axis 230 of the enclosure cavity 202. This match between the case aperture 308 and the enclosure aperture 204 ensures that an inserted plug cannot come into contact with the shielding 100, which has an aperture 114 larger in circumference than the other two. Thus, the only electrical communication between an inserted plug and the shielding 100 would be as a result of a spark jumping the gap between the plug surface and the edge of the shielding aperture 114.

Figure 5:
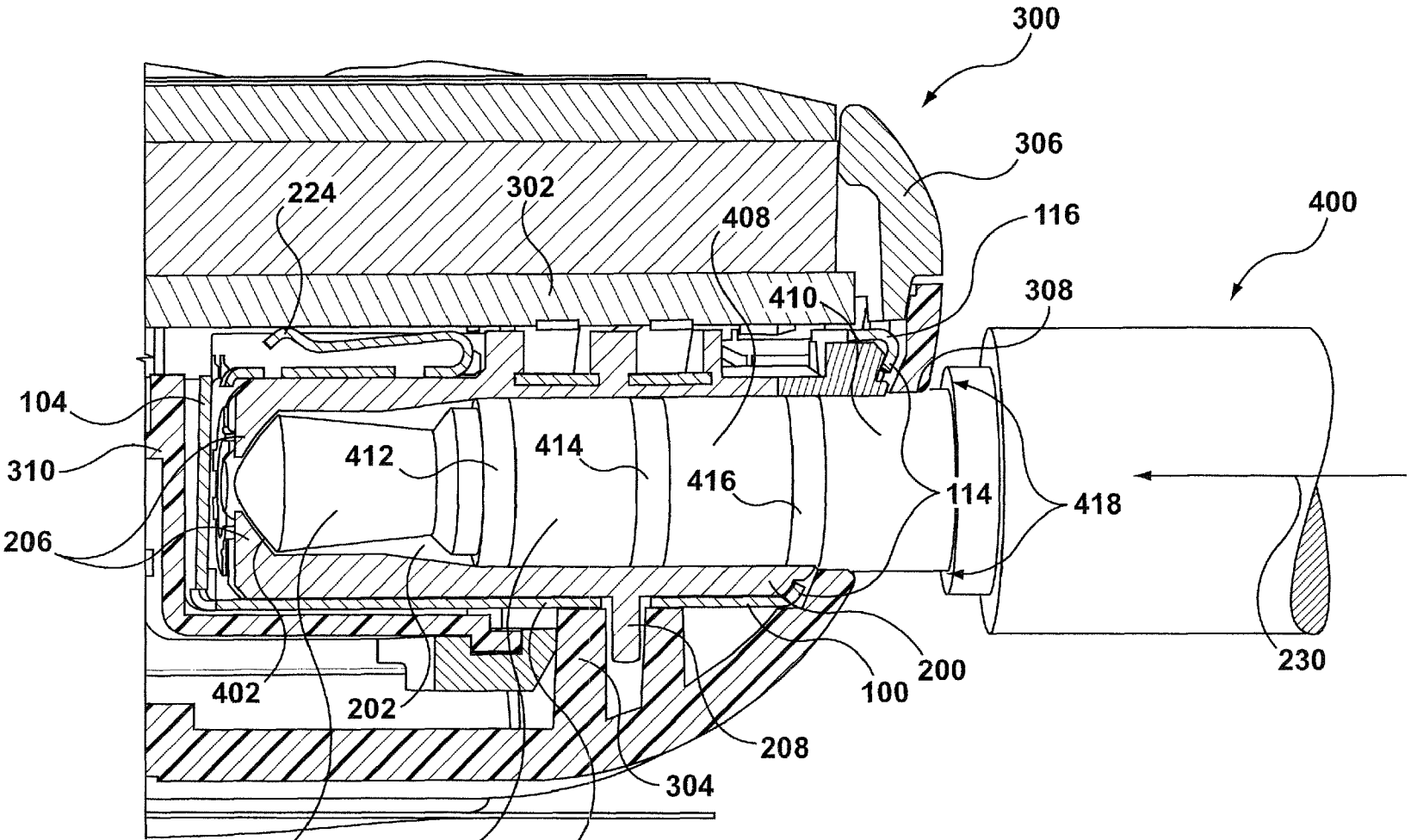
FIG. 5 is a cross-sectional view of the exemplary embodiment of FIG. 1 mounted within an exemplary electronic device and having an exemplary plug inserted thereinto, the cross-section taken through a vertical plane along the longitudinal axis of the audio jack cavity.

FIG. 5 shows a cross-sectional view of the enclosure cavity 202 of the exemplary audio jack of FIGS. 1 to 4 in the context of an exemplary electronic device 300. The jack is here shown with its bottom face 102 facing downward and the PCB 302 of the device 300 positioned above the top surface of the enclosure 200. The fourth PCB spring contact 224 is shown in contact with the PCB 302. The clip 116 retaining the front face 106 of the shielding 100 to the enclosure 200 is shown curving around the corner of the enclosure 200. The gap between the shielding aperture 114 and the enclosure aperture 204 is also apparent in this view, as is the correspondence between the size of the enclosure aperture 204 and the case aperture 308. The device case 306, formed out of a non-conductive material such as hard plastic, encloses the various components of the device 300.

An exemplary audio plug 400 is also shown here inserted into the enclosure cavity 202. The audio plug 400 is of a TRRS type, having an elongate cylindrical shape split up by insulating rings to form four separate contacts (tip, ring, ring, and sleeve). The contact most proximal to the base 418 of the plug 400 is the plug sleeve contact 410. This is separated by a first insulating ring 416 from a second plug contact 408 in the shape of a conductive ring, which is in turn separated by a second insulating ring 414 from a third plug contact 406, also in the shape of a ring, which is finally separated by a third insulating ring 412 from the plug tip contact 404 at the distal end 402 of the plug 400. In the exemplary embodiments of the audio jack described above, the plug sleeve contact 410 is in electrical communication with the first cavity contact 210 when the plug 400 is fully inserted into the cavity 202, and the second plug contact 408 is in electrical communication with the second cavity contact 212. The third plug contact 406 and plug tip contact 404 are also in electrical communication with a third cavity contact and end cavity contact (not shown), respectively.

A further feature of the audio jack shown in FIG. 5 is the mechanism by which it is maintained in place within the device 300 housing. The enclosure 200 has a mechanical stopping pin 208 which protrudes through an opening in the bottom face 102 of the shielding 100 to hold the jack in place and resist longitudinal forces from an plug 400 inserted along the longitudinal axis 230 of the cavity 202. This stopping pin 208 acts in concert with a chamfered rear end 206 of the cavity 202 having a shape complementary to the plug tip 402. When the tip 402 of the plug 400 comes into contact with the rear end 206 of the cavity 202, any further force of insertion along the longitudinal axis 230 of the cavity 202 is absorbed by the stopping pin 208 held in place by a complementary stopping surface 304 of the device 300.

This stopping mechanism has a dual purpose. First, it prevents any force from being transferred to the rear surface 310 of the device housing in which the jack is situated. This may be important to prevent damage or wear to components located near the rear surface 310 of the housing. In particular, the rear surface 310 may be an integral part of another component of the device 300 that may be degraded by repeated contact forces. For example, the component may house gaskets or other sealing elements that may be dislodged or compromised by repetitive impact forces. Second, the stopping mechanism allows a small gap to be maintained between the outside surface of the device case 306 and the base 418 of the plug 400. In this exemplary embodiment, the plug 400 has a base 418 wider than its sleeve; without the stopping mechanism in place, the plug might be inserted so far as to bring the base 418 of the plug 400 into direct contact with the device case 306. This might have detrimental effects on the plug 400 and/or device 300, whereas leaving a small gap between them creates tolerances and prevents damage caused by contact between these two surfaces.

Many audio connectors include a non-conductive extender surrounding a plug aperture and extending to the exterior of the device case. The exemplary embodiments of the audio jack described above differ from this design in that there is no extender, and no part of the jack other than the interior of the cavity 202 is visible from the outside of the device 300. This is a consequence of the circumference of the case aperture 308 substantially matching that of the enclosure aperture 204, leaving no gap for interposition of an extender. The thickness of the device case 300 instead fulfills substantially the same function as a non-conductive extender, and results in an entire audio jack assembly with a shorter length than a typical extended audio jack.

In some embodiments, the different plug contacts may carry various audio signals, including speaker signals and microphone signals. For example, the plug tip contact 404 may receive a left stereo speaker signal that is conveyed from a cavity end contact, and which is in turn conveyed from one of the PCB spring contacts, such as the fourth PCB spring contact 224. This fourth PCB spring contact 224 in such an embodiment would be mounted on the PCB 302 in communication with a left stereo speaker lead on the PCB 302, thereby receiving the left stereo speaker signal from an audio subsystem of the device 300. By the same token, the third plug contact 406 might carry a right stereo speaker signal, which would be conveyed through a third cavity contact and the third PCB spring contact 222 from a right stereo speaker lead on the PCB 302. The second plug contact 408 in such an embodiment might serve as a grounding contact, connecting the plug 400 to a system ground or separate audio ground for the device 300 via the second cavity contact 212 and the second PCB spring contact 220. The plug sleeve contact 410 might carry a microphone signal and convey it through the first cavity contact 210 to the first PCB spring contact 218 and thence to a microphone signal lead on the PCB 302, feeding into the audio subsystem of the device 300. In such an embodiment, the first cavity contact 210 might serve some additional purpose as well, such as protecting against electrostatic discharge by communicating with an electrostatic discharge protection component of the device 300. Alternatively, the functions of the various cavity contacts and PCB spring contacts might be rearranged depending on the convention used in the device 300 and the plug 400.

In some embodiments, the cavity contacts may be placed so as to prevent the plug sleeve contact 410 from coming into electrical communication with any of the cavity contacts when the plug 400 is fully inserted. The first cavity contact 210 may come into electrical communication with the second plug contact 408 instead of the plug sleeve contact 410, and the other cavity contacts may correspondingly come into electrical communication with different plug contacts as well.

Some embodiments may use one of the PCB spring contacts to convey a non-audio signal, such as a signal indicating that the plug has been inserted. Alternatively, one or more of the PCB spring contacts could be used to ground the plug and/or to connect one or more contacts of the plug sleeve to additional electrical components of the PCB, such as an electrostatic discharge element. In some embodiments, one or more of the PCB spring contacts may be formed integrally with the shielding 100 or may be in electrical communication with the shielding 100, thereby using the grounding spring contact 112 of the shielding 100 to ground any element in communication with that PCB spring contact. It will be further appreciated that the various spring contacts, including the grounding spring contact 112, may take different forms in other embodiments, such as pins adapted for soldering to a printed circuit board.

In an alternate embodiment, the jack is not an audio jack, but is a shielded enclosure for some other type of electrical connector carrying one or more analog and/or digital signals.

In a further alternate embodiment, the mechanical stopping pin 208 may have a shape different from a pin and may come into contact with a complementary structure of the device 300 to hold the jack in place. Different embodiments may have the mechanical stopping pin 208 or other stopping element protruding from different surfaces of the audio jack, and/or protruding in different directions. In some embodiments, the stopping element may be formed from a separate piece of material from the enclosure.

The various embodiments presented above are merely examples and are in no way meant to limit the scope of this disclosure. Variations of the innovations described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. An audio jack for an audio plug for use in an electrical device, comprising:

a non-conductive enclosure having a front side and defining a cavity having an aperture within the front side for receiving the audio plug, the aperture having a first diameter, the cavity extending along a longitudinal axis;

a conductive shielding formed from sheet metal folded over at least five sides of the enclosure including the front side, the shielding defining a shielding aperture centered on the enclosure aperture and having a second diameter larger than the first diameter;

a ground contact connected to the conductive shielding and having a ground spring contact external to the non-conductive enclosure and biased to contact a grounding plane on a printed circuit board;

one or more cavity contacts situated within the cavity to come into electrical communication with one or more conductive surfaces of an inserted audio plug;

one or more spring PCB contacts biased to contact and electrically communicate with leads of the printed circuit board, each PCB contact being in electrical communication with one or more of the cavity contacts; and a non-conductive stopping member extending from a surface of the enclosure opposite to the spring contacts through an opening in the shielding, the non-conductive stopping member extending substantially perpendicular to the longitudinal axis of the cavity and adapted to abut a complementary surface, thereby transferring any forces upon the audio jack along the longitudinal axis to the complementary surface.

2. The audio jack of claim 1, wherein the ground contact is connected to the conductive shielding proximal to the shielding aperture.

3. An electronic device incorporating the audio jack of claim 1, comprising a rigid, non-conductive case defining a case aperture centered on the on the enclosure aperture and having a diameter smaller than the second diameter.

4. The device of claim 3, wherein the diameter of the case aperture is substantially the same as the first diameter.

5. An electronic device incorporating the audio jack of claim 1, comprising:

a rigid, non-conductive case defining an aperture centered on the on the enclosure aperture and having a diameter smaller than the second diameter;

an audio subsystem having a left stereo speaker signal output, a right stereo speaker signal output, a microphone signal input, and an audio ground; and a printed circuit board having a left stereo speaker lead in communication with the left stereo speaker signal output of the audio subsystem, a right stereo speaker lead in communication with the right stereo speaker signal output of the audio subsystem, a microphone lead in communication with the microphone signal input of the audio subsystem, and an audio ground lead in communication with the audio ground, the left stereo speaker lead, right stereo speaker lead, microphone lead, and audio ground lead being positioned such that each comes into contact with one or more of the PCB contacts of the audio jack when the audio jack is mounted on the printed circuit board.

6. The device of claim 5, wherein the cavity contacts of the audio jack comprise:

a microphone cavity contact in communication with a PCB contact positioned to communicate with the microphone lead of the printed circuit board;

a right speaker cavity contact in communication with a PCB contact positioned to communicate with the right speaker lead of the printed circuit board;

a left speaker cavity contact in communication with a PCB contact positioned to communicate with the left speaker lead of the printed circuit board; and an audio ground cavity contact in communication with a PCB contact positioned to communicate with the audio ground lead of the printed circuit board.

7. The device of claim 6, wherein the microphone cavity contact, the audio ground cavity contact, the right speaker cavity contact, and the left speaker cavity contact are arranged in sequence from the enclosure aperture to the distal end of the cavity.

8. An electronic device incorporating the audio jack of claim 1, comprising:

a rigid, non-conductive case defining a case aperture centered on the enclosure aperture and having a diameter smaller than the second diameter; and a stopping surface placed so as to abut and complement the non-conductive stopping member of the enclosure and absorb any force on the audio jack along the longitudinal axis.

* * * * *